US011155429B2

(12) United States Patent
Paladini et al.

(10) Patent No.: US 11,155,429 B2
(45) Date of Patent: Oct. 26, 2021

(54) MACHINE AND METHOD FOR WINDING STRIPS OF WEB MATERIAL WITH MEANS FOR THE TRANSVERSE CUTTING OF THE STRIPS AT THE END OF WINDING

(71) Applicant: A.CELLI NONWOVENS S.P.A., Porcari (IT)

(72) Inventors: Riccardo Paladini, Bagni di Lucca (IT); Giuseppe Acciari, Porcari (IT); Simone Bertuccelli, Porcari (IT)

(73) Assignee: A.CELLI NONWOVENS S.P.A., Porcari (IT)

( * ) Notice: Subject to any disclaimer, the term of this patent is extended or adjusted under 35 U.S.C. 154(b) by 310 days.

(21) Appl. No.: 16/344,472

(22) PCT Filed: Oct. 25, 2017

(86) PCT No.: PCT/EP2017/077311
§ 371 (c)(1),
(2) Date: Apr. 24, 2019

(87) PCT Pub. No.: WO2018/077950
PCT Pub. Date: May 3, 2018

(65) Prior Publication Data

US 2020/0055686 A1 Feb. 20, 2020

(30) Foreign Application Priority Data

Oct. 27, 2016 (IT) ..... 102016000108463

(51) Int. Cl.
*B65H 19/26* (2006.01)
*B65H 18/10* (2006.01)
(Continued)

(52) U.S. Cl.
CPC ..... *B65H 19/26* (2013.01); *B65H 18/10* (2013.01); *B65H 18/26* (2013.01);
(Continued)

(58) Field of Classification Search
CPC .... B65H 19/26; B65H 19/28; B65H 19/2284; B65H 18/10; B65H 18/26; B65H 2301/5151; B65H 2301/414321
See application file for complete search history.

(56) References Cited

U.S. PATENT DOCUMENTS 5,305,965 A * 4/1994 Yamada ..... B65B 63/04 226/92
2003/0150546 A1* 8/2003 Kataoka ..... B65H 35/02 156/185
(Continued)

FOREIGN PATENT DOCUMENTS

EP 0 698 472 A1 2/1996
EP 1 609 749 A1 12/2005
(Continued)

*Primary Examiner* — Sang K Kim
(74) *Attorney, Agent, or Firm* — McGlew and Tuttle, P.C.

(57) ABSTRACT

The machine (1) comprises: —an unwinding section (3) for unwinding parent reels (Ba, Bb) of web material (N; S); —at least one winding station (15) comprising a winding device (25) and further comprising: guide members for guiding the strip (S) of web material, configured to form at least a loop of web material between a guide roller (43) and a log (B); and a cutting device (61) for transversally cutting the strip (S) of web material in an intermediate position between the log (B) and the guide roller (43), thus generating a tail edge, remaining on the log (B) being formed, and a leading edge, remaining fastened to the guide roller (43).

24 Claims, 9 Drawing Sheets

(51) Int. Cl.
*B65H 18/26* (2006.01)
*B65H 19/22* (2006.01)
*B65H 19/28* (2006.01)

(52) U.S. Cl.
CPC ..... *B65H 19/2284* (2013.01); *B65H 19/28* (2013.01); *B65H 2301/414321* (2013.01); *B65H 2301/5151* (2013.01)

(56) References Cited

U.S. PATENT DOCUMENTS

| | | | | |
|---|---|---|---|---|
| 2010/0155522 | A1* | 6/2010 | Arimitsu ..... | B65H 19/2215 242/412 |
| 2017/0327336 | A1* | 11/2017 | Vergentini ..... | B25J 15/0047 |
| 2017/0327338 | A1* | 11/2017 | Vergentini ..... | B65H 19/283 |

FOREIGN PATENT DOCUMENTS

| | | | |
|---|---|---|---|
| GB | 2 161 793 | A | 1/1986 |
| JP | 8-198485 | A | 8/1996 |
| WO | 02/053483 | A1 | 7/2002 |
| WO | 2015/140466 | A1 | 9/2015 |

* cited by examiner

MACHINE AND METHOD FOR WINDING STRIPS OF WEB MATERIAL WITH MEANS FOR THE TRANSVERSE CUTTING OF THE STRIPS AT THE END OF WINDING

TECHNICAL FIELD

The present invention relates to machines for producing logs of web material, for example logs formed by strips of nonwoven fabric.

Embodiments of the invention disclosed herein particularly refer to improvements to systems for severing the web material when a log has been formed.

BACKGROUND TO THE INVENTION

In many industrial fields, logs of web material having a given dimension shall be transformed into logs of different dimension, through a process involving unwinding of parent reels, also called jumbo rolls, and winding new logs of different dimension. In some cases the web material from a single parent reel is unwound and subdivided into longitudinal strips, each of which is helically wound on a log. The final logs are used as semi-finished products to feed lines for the manufacturing of further products.

Sometimes, the machines that produce logs made of strips of web material helically wound from parent reels are called spooling machines. The web material may be a nonwoven fabric. The helically wound logs are used, for example, to feed machines for the production of baby and adult diapers and other hygienic and sanitary products. Sometimes, the web material wound on the parent reels has a cross dimension (corresponding to the axial dimension of the parent reel) equal to 5-15 times the width of the single longitudinal strips cut from the web material of the parent reels. The single strips are simultaneously fed to helical winding stations, in each of which a helically wound log is formed. The winding stations are arranged in line, one following the other, in machine direction, defined by the feed direction of the longitudinal strips cut from the web material of the parent reels. Each strip is fed to the respective winding station along a feed path.

When a helically wound log has been completed, the strip of web material shall be severed, and the completed helically wound log shall be removed from the respective winding station and replaced with a new tubular winding core, on which the leading edge of the strip shall be anchored to start winding a new log.

WO-A-2015/140466 discloses a helical winding station of a spooling machine with a system for perforating the strip of web material when a helically wound log has been formed. The perforation line is a pre-breakage line to sever the strip of web material. The perforation line is broken by pulling the strip of web material.

The device and method for severing the web material when the winding is finished described in the above mentioned document may be subject to malfunctions. Moreover, the operations necessary to start a new winding are complex due to the ways in which the web material is severed.

A need therefore exists for a more reliable device allowing severing the web material with a greater degree of repetition and safe result.

SUMMARY OF THE INVENTION

In order to solve, partially or completely, the drawbacks of the prior art winding machines, especially as regards the transitory step of stopping winding a completed log, a machine is provided, comprising:

an unwinding section for unwinding parent reels of web material;

at least one winding station comprising a winding device, to which a longitudinal strip of web material is fed, and in which a respective log of web material is formed.

The winding station further comprises guide members for guiding the strip of web material, configured to form at least a loop of web material between a guide roller and a log at the end of log winding. The winding station further comprises a cutting device for transversally cutting the strip of web material in an intermediate position between the log and the guide roller, thus generating a tail edge, remaining on the log being formed, and a leading edge, remaining fastened to the guide roller. The cutting device and the guide members are advantageously arranged so that the cut of the strip of web material is performed downstream of the loop formed by means of the guide members, so that the loop is constrained to the guide member when the formed log is moved away from the winding station. In this way, in the winding station a strip portion (represented by the above mentioned loop) is made available, with which the operator can anchor the strip of web material to a subsequent tubular winding core around which the new log will be formed.

In order to facilitate anchoring of the leading edge of the strip on the new tubular winding core, the strip portion available to start winding shall be so long as to form a complete turn around the new tubular winding core. In advantageous embodiments, to have a sufficiently long strip portion the guide members comprise a plurality of guiding elements substantially parallel to one another and movable with respect to one another, in order to form a plurality of loops of web material. The loops form a sort of stock of web material.

The winding device comprises a winding mandrel provided with a rotary motion around a rotation axis. In order to form helically wound logs, the winding mandrel is also provided with a reciprocating translation motion in a direction parallel to the rotation axis thereof.

In order to control the winding density, in some embodiments a contact roller is associated with the winding mandrel, the roller rotating around a rotation axis and being configured to be pressed against the outer surface of a log being formed on the winding mandrel. The contact roller has preferably a rotation axis parallel to the rotation axis of the guide roller. In advantageous embodiments, the guide members are arranged to form the loop or loops of web material between the guide roller and the contact roller.

In order to allow the contact roller to follow the growing log and to facilitate the operations of removing the formed log and replacing it with a new tubular winding core, the contact roller may be supported by a first movable arm, so that it can be moved towards and away from the rotation axis of the log in the winding station. The first arm can be, a pivoting arm, for instance, i.e. an arm provided with a reciprocating rotary motion around an articulation axis, preferably parallel to the rotation axis of the contact roller.

In some embodiments, the guide roller may be supported by a second movable arm, so as to be moved towards and away from the rotation axis of the log being formed and the contact roller.

In some embodiments, the guide members may comprise one or more guiding elements. In some embodiments, at least one guiding element is mounted on the second arm. The guiding element may be movable with respect to the guide roller to form a loop of web material between the guiding element and the guide roller.

In improved embodiments of the invention, to generate a sufficiently long strip of web material, the guide members comprise three guiding elements or bars, for example a first bar or element mounted fixed on the second arm, and the remaining two bars or elements movable with respect to the first bar or element.

The two movable bars or elements may be mounted, for example, on a slide movable along the second arm, in order to move towards and away from the first guiding bar, stationary on the second arm.

In some embodiments, the cutting device may be advantageously supported by the second arm. The cutting element may comprise a blade co-acting with an anvil. The anvil may be formed in one of the guiding bars or elements.

According to a further aspect, a method is provided for winding a strip of web material on a log being formed rotating around a rotation axis, with a machine as described above, comprising the steps of:

winding a length of the strip of web material on a first log being formed in the winding station;

at the end of winding of said first log, forming at least one loop of web material between the guide roller and the formed log, and severing the strip of web material by means of the cutting device, forming a tail edge of the first log and a leading edge of the second log;

removing the first log from the winding station;

inserting a new tubular winding core into the winding station;

applying the leading edge to the new tubular winding core;

starting winding a new log around the new tubular winding core.

BRIEF DESCRIPTION OF THE DRAWINGS

The present invention will be better understood by means of the description below and the attached drawing, which shows a non-restrictive practical embodiment of the invention. More particularly, in the drawing.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Here below reference will be made to a spooling machine, i.e. a helically winding machine, wherein a web material is subdivided into a plurality of longitudinal strips that are fed in parallel to a plurality of winding stations. The winding devices in each winding station are configured to form helically wound logs, giving the log being formed a rotary motion around a rotation axis and a reciprocating translation motion in a direction parallel to the rotation axis. In other embodiments, not shown, only one winding station can be provided, if necessary a helically winding station. In further embodiments, one or more spiral winding stations may be provided, i.e. without reciprocating translation motion.

Figure 1:
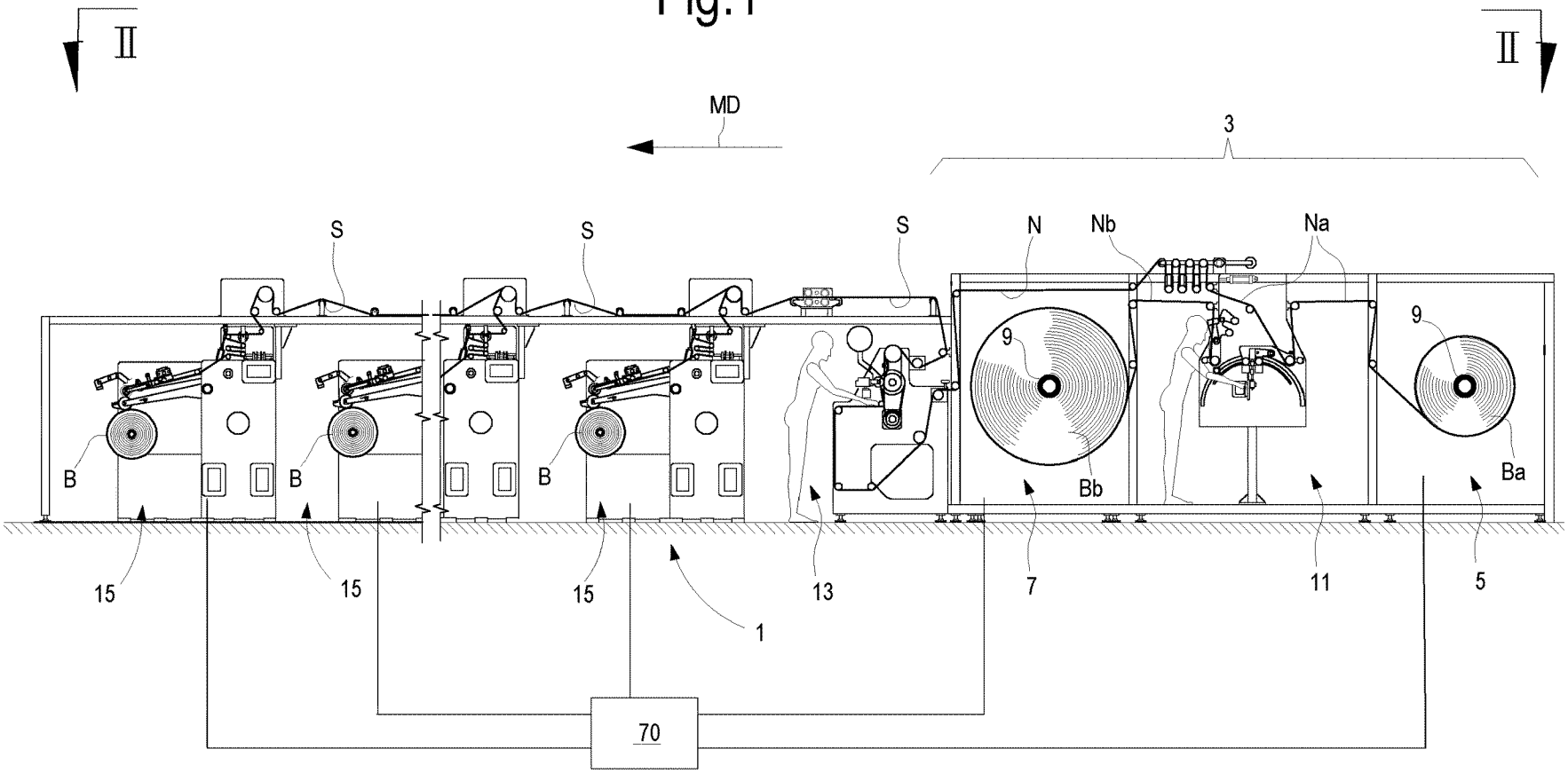
FIG. 1 is a side view of the machine and the main stations thereof.

FIG. 1 shows a side view of the machine for producing helically wound logs. Actually, the machine is a processing line comprising a plurality of stations. The machine is indicated as a whole with reference number 1. It has an unwinding section 3, where the parent reels, also called jumbo rolls or master rolls and indicated with Ba and Bb in FIG. 1, are installed. In the illustrated embodiment, the unwinding section 3 comprises a first unwinding station 5 and a second unwinding station 7. The two unwinding stations 5 and 7 may be substantially mirror-like, and each of them has an unwinding mandrel 9, on which the parent reels Ba, Bb are mounted. The parent reels contain a certain amount of web material, indicated with Na and Nb in FIG. 1 for the reels Ba and Bb respectively.

A cutting and welding station 11 may be provided between the two unwinding stations 5, 7; in the cutting and welding station the tail of a web material of a nearly empty parent reel, arranged in one of the unwinding stations 5, 7, is welded to the leading edge of a new parent reel arranged in the other of the two unwinding stations 5, 7, to allow continuous processing of more parent reels sequentially. Before welding web materials from subsequent parent reels, the unwinding of the nearly empty reel shall be slowed down or temporary stopped, as the described machine is of the start-stop type. In other embodiments, the welding station is arranged downstream of the two unwinding stations 5, 7. In some embodiments, more than two unwinding stations may be provided.

Figure 2:
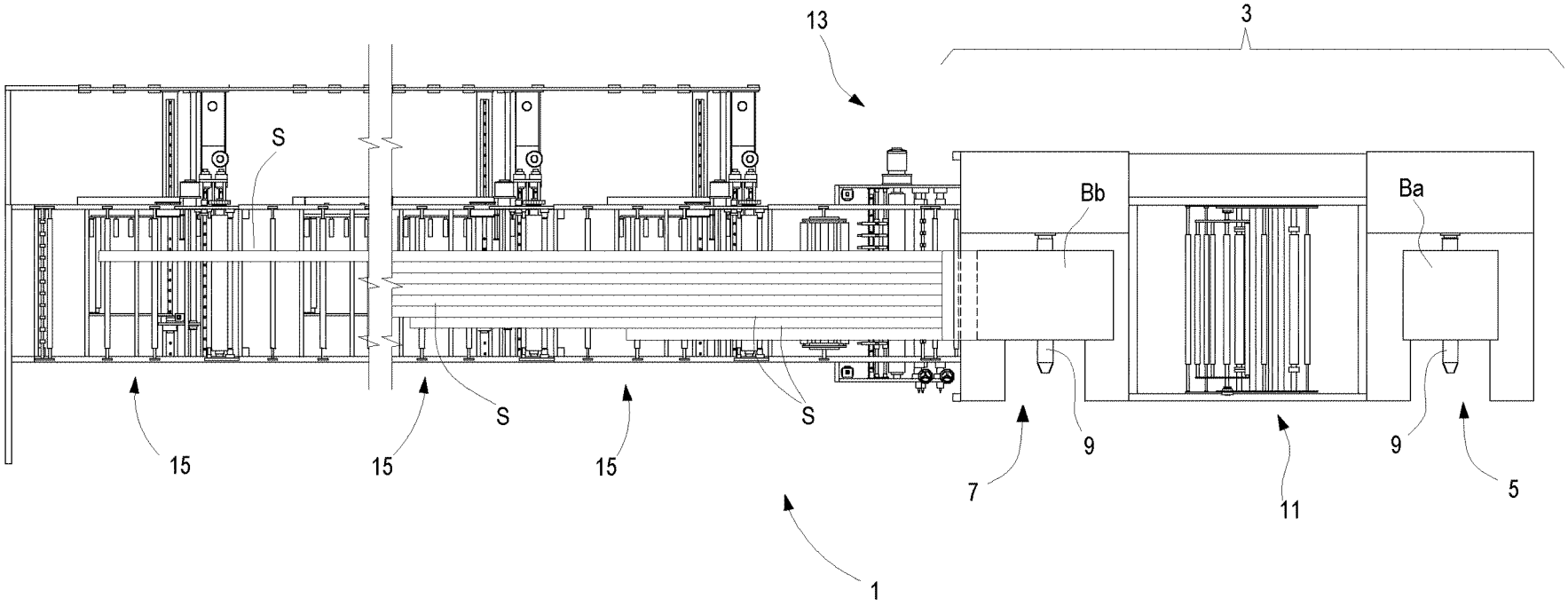
FIG. 2 shows a plan view according to II-II in FIG. 1.

A cutting station 13 is provided downstream of the unwinding station 3, where the web material N fed from the unwinding section is longitudinally cut and subdivided into a plurality of longitudinal strips S, that are fed to a plurality of helical winding stations, which can be equal to one another, each of which is indicated with reference number 15. The helical winding stations 15 are arranged in sequence according to the machine direction, usually indicated by the arrow MD and represented by the direction along which the longitudinal strips S move forward. For the sake of clarity of representation, in FIGS. 1 and 2 only three winding stations 15 are partially shown, but it should be understood that the number of winding stations may be comprised between two and ten or more, if necessary, based on the number of longitudinal strips S into which a web material N can be subdivided.

Each strip S, into which the web material N from the unwinding station is subdivided, advances along a path from the cutting station 13 to the respective winding station 15. In advantageous embodiments, the feed path is arranged above the winding stations, but it can be also arranged below the winding stations 15.

The path of a given strip S of web material has a different length than the path of the remaining longitudinal strips and depends on the position of the respective winding station 15, where the strip of web material is fed.

Reference number 70 generically indicates a control unit, for example a microprocessor, a micro-computer or a PLC, for controlling one or more stations forming the machine 1. In some embodiments, the machine 1 may be provided with a plurality of PLCs or other local control units suitable, for example, to control the operation of a part, a section or a station of the machine 1. The central control unit 70 may control and coordinate various local control units or local PLCs. In other embodiments, a single control unit may be provided for managing the whole line or machine 1, or a plurality of stations thereof.

FIGS. 3 to 9 show a winding station 15 in different steps of a winding cycle of a log B of web material. The winding station 15 comprises a bearing structure 17, onto which two crossbars 19 are mounted, which are substantially orthogonal to the feed direction of the strip S of web material, indicated by the arrow MD. Guides 21 are provided on the crossbars 19 for a carriage 23 movable in a direction orthogonal to the direction MD, i.e. parallel to the crossbars 19. The carriage 23 carries a winding device comprising a winding mandrel 25 onto which tubular winding cores 26 are mounted, around which the logs B of web material are formed. The mandrel 25 may be driven into rotation around a rotation axis A-A thereof by means of an electric motor 27 through a belt 29. The electric motor 27 is carried by the carriage 23.

In some embodiments, the carriage 23 is provided with a reciprocating rectilinear motion according to the double arrow f23 (see FIGS. 8 and 9), thus moving the winding mandrel 25 with reciprocating rectilinear motion. The reciprocating translation motion combined with the rotation motion of the mandrel 25 causes the strip S to be helically wound.

In some embodiments, the carriage 23 carries a first arm 31 hinged around an axis 31A substantially parallel to the axis A-A of the mandrel 25. Reference number 33 indicates an actuator, for example a cylinder-piston actuator, controlling the oscillation of the first arm 31 according to the double arrow f31.

Figure 8:
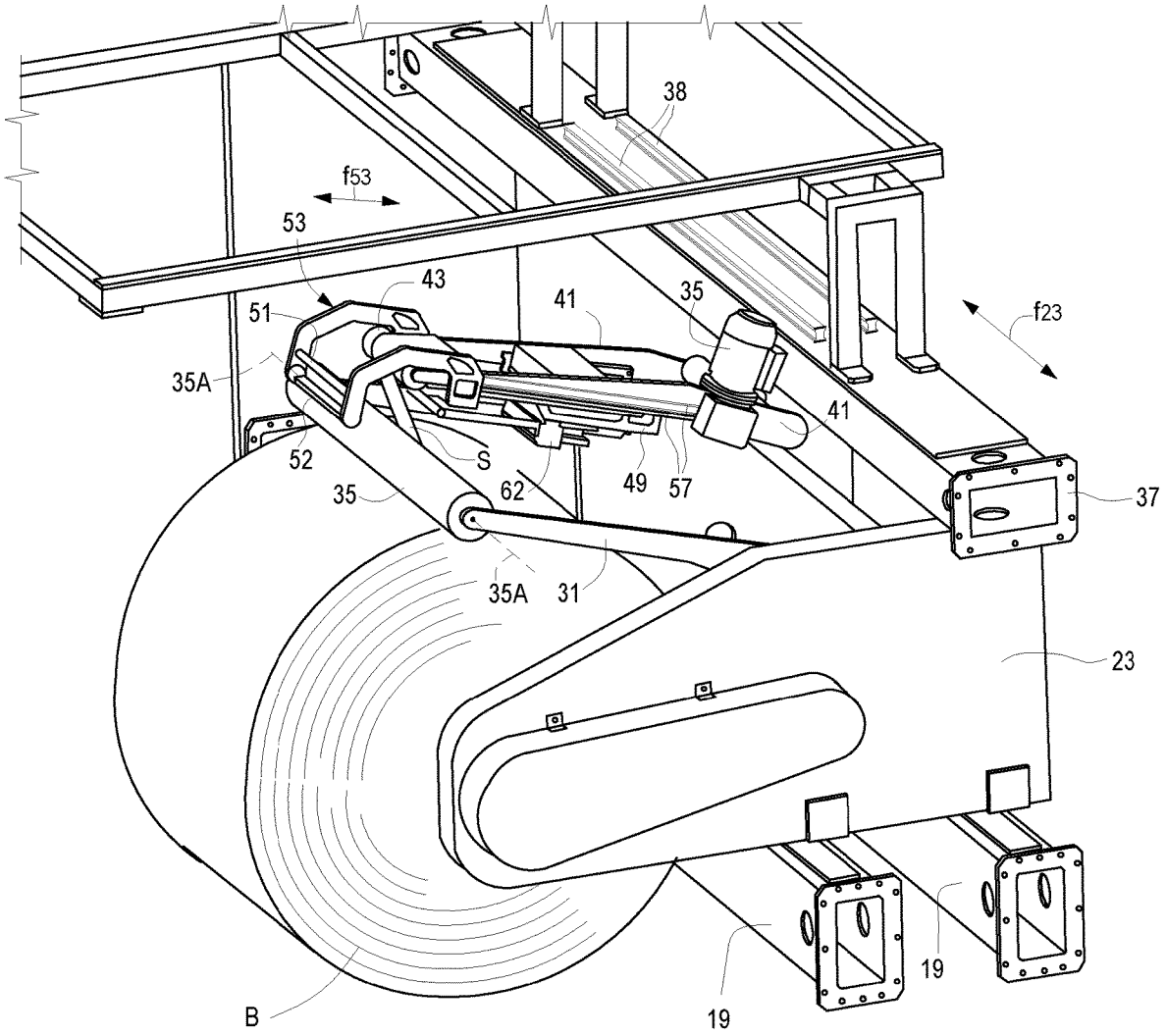
FIGS. 8 and 9 are axonometric views of the station shown in FIGS. 3 to 7 in two different positions.
Figure 9:
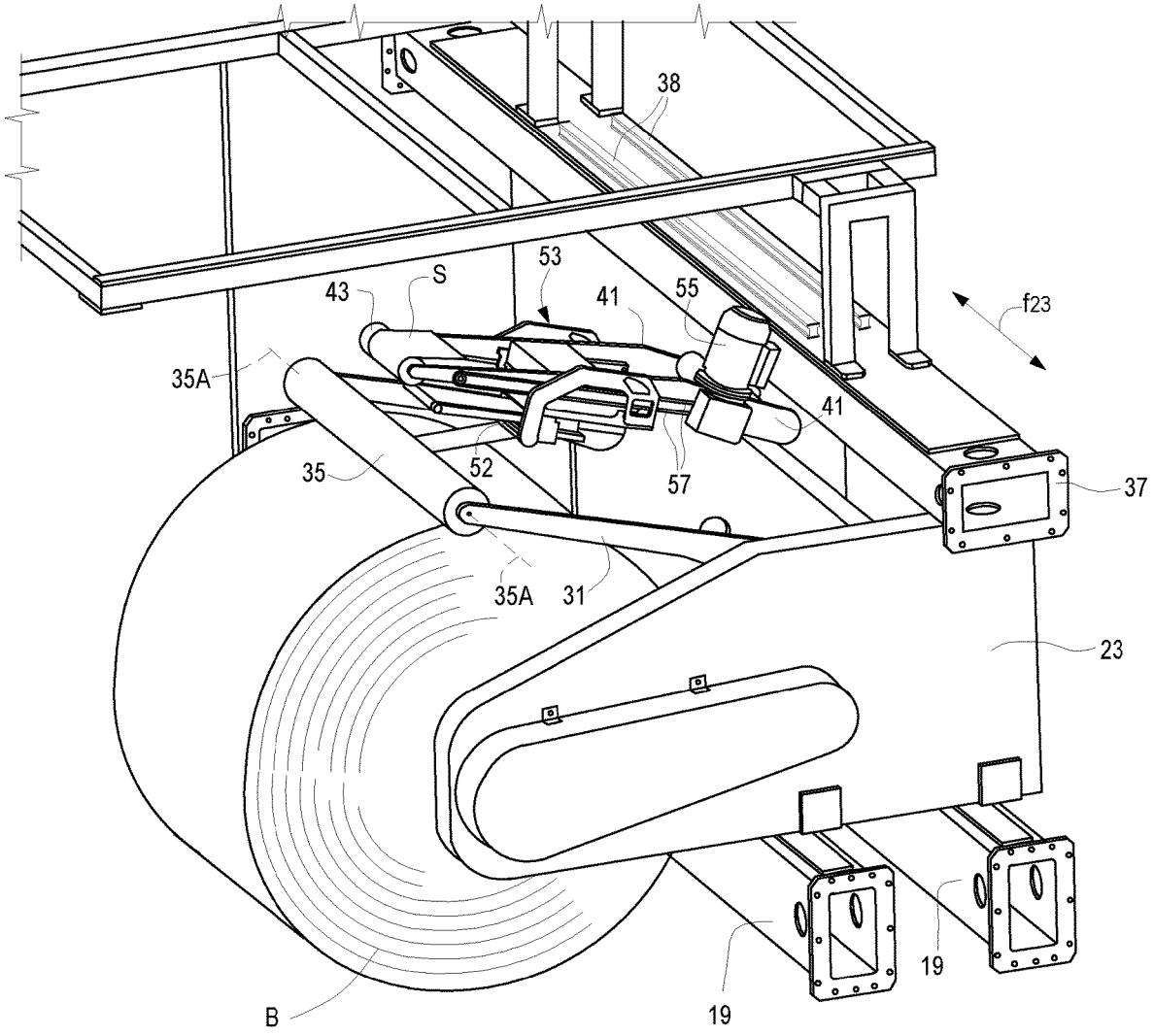

Actually, the first arm 31 may be formed by two parallel semi-arms as shown in FIGS. 8 and 9. The first arm 31 carries a contact roller 35 with an axis 35A, substantially parallel to the axis A-A of the winding mandrel 25. The contact roller 35 may be idle. The cylinder-piston actuator 33 controlling the movement of the first arm 31 can also control the pressure exerted by the contact roller 35 on the log B being wound, for example to control the winding density.

The winding station 15 may further comprise a crossbar 37, substantially parallel to the crossbars 19. Guides 38 may be provided on the crossbar 37 for a slide 39 movable parallel to the axis A-A of the winding mandrel 25. The movement of the slide 39 along the crossbar 37 is an adjustment movement to position correctly the slide 39 with respect to the machine width, i.e. with respect to the winding mandrel 25. The slide 39 has been omitted in FIGS. 8 and 9 for the sake of clarity of representation.

In the illustrated embodiment, the slide 39 carries a second arm 41, hinged around an axis 41A, substantially parallel to the rotation axis of the winding mandrel 25. An actuator, for example a cylinder-piston actuator 40, controls the oscillation of the second arm 41 around the axis 41A according to the double arrow f41.

As for the first arm 31, also the second arm 41 can be actually formed by two semi-arms, as shown in FIGS. 8 and 9. The second arm 41 carries a guide roller 43, with an axis substantially parallel to the axis of the winding mandrel 25 and to the axis of the contact roller 35. The guide roller 43 may be idle.

The second arm 41 or the first arm 31 may be provided with members suitable to keep the contact roller 35 and the guide roller 43 spaced from each other. For example, in some embodiments the second arm 41 carries a wheel 42 mounted to rotate idly around an axis oriented at 90° with respect to the axis of the guide roller 43. The wheel 42 may be carried by a support 42A rigidly fixed to the second arm and rest on a sheet or crossbar 42B integral with the first arm 31. The dimension of the support 42A is such that, when the wheel 42 rests on the crossbeam 42A, the guide roller 43 and the contact roller 35 are slightly spaced from each other.

Alternatively, the system may provide for a wheel that is coaxial with the guide roller 43, has greater diameter than the guide roller, rests on the contact roller 35 and rolls on it. In this way the direct contact between the guide roller 43 and the contact roller 35 is avoided. In fact, during winding the guide roller 43 and the contact roller shall remain at a given reciprocal distance.

The pneumatic actuator 40 has only the function of reducing the weight of the guide roller 43 during winding, while lifting the first arm 41 and the guide roller 43 when winding is finished, with the consequent detachment of the wheel when the strip of web material is cut, that is when the guide roller 43 and the contact roller 35 shall be sufficiently spaced from each other.

In addition to the guide roller 43, the second arm 41 carries also guide members that can modify the path of the strip S of web material between the guide roller 43 and the log B being formed. In some embodiments, the guide members comprise fixed elements and elements movable with respect to the second arm 41. In some embodiments, the guide members may comprise guiding bars. A guiding bar is any mechanical member elongated in shape, with a surface suitable to guide the strip S of web material therearound. For example, the guiding bar may comprise an idle roller, or a fixed cylinder.

In the illustrated embodiment, the guide members comprise a first guiding element, for example a first guiding bar 47 supported in a substantially fixed position by the second arm 41. To this end, the second arm 41 may carry a support structure 49 fixed below the second arm 41. The first guiding bar 47 may be arranged below the guide roller 43 and slightly nearer to the pivot axis 41A of the second arm 41 than the guide roller 43.

The guide members may comprise a further guiding bar, movable with respect to the second arm 41, or, preferably, a pair of further guiding bars, movable with respect to the second arm 41. In the illustrated embodiment, a pair of guiding bars 51 and 52 is provided. The guiding bars 47, 51, and 52 are substantially parallel to one another and the guiding bars 51 and 52 are mounted on a slide 53 movably supported on guides 54 arranged on the two semi-arms forming the second pivoting arm 41. The bars 51 and 52 could be mounted also on separate slides. Practically, the slide 53 may comprise two brackets for supporting the pair of bars 51, 52.

The slide 53 is provided with reciprocating rectilinear motion according to the double arrow f53 with respect to the second pivoting arm 41. The reciprocating rectilinear motion of the slide 53 may be imparted by an suitable actuator. In the illustrated embodiment, an electric motor 55 is provided to this end, mounted on the second pivoting arm 41. The electric motor 55 may transmit motion to the slide 53 through a belt 57 or any other endless flexible member. The slide 53 is fixed to one of the two branches of the belt 57, so that the rotation of the electric motor 55 in two directions results in the reciprocating rectilinear motion of the slide 53.

The guiding bars 51 and 52 are suitably spaced from each other and arranged, with respect to the slide 53, so that, moving integrally with the slide 53, the guiding bars 51 and 52 pass above and below the guiding bar 47 respectively, as it will be better explained below with reference to a winding cycle.

An anvil 59 may be associated with the guiding bar 52, the anvil co-acting with a blade 61 carried by the support structure 49. In some embodiments, the blade 61 may be provided with a reciprocating rectilinear movement according to the double arrow f61, which can be controlled by an actuator 63, for example a cylinder-piston actuator. Reference number 65 indicates a guide integral with the bearing structure 49, along which the blade 61 moves.

The blade 61 may be a toothed blade or a smooth blade, and is configured to co-act with the anvil 59 to cut the strip S of web material when a log B has been completely formed.

The second arm 41 may carry a brake 67 for stopping the strip of web material after the cut by means of the blade 61, so as to hold the end portion of web material constrained to the second arm 41.

Having described the main members of the winding station 15, now, a winding and cutting cycle of the strip S of web material will be described with reference to the sequence of FIGS. 3 to 7.

Figure 3:
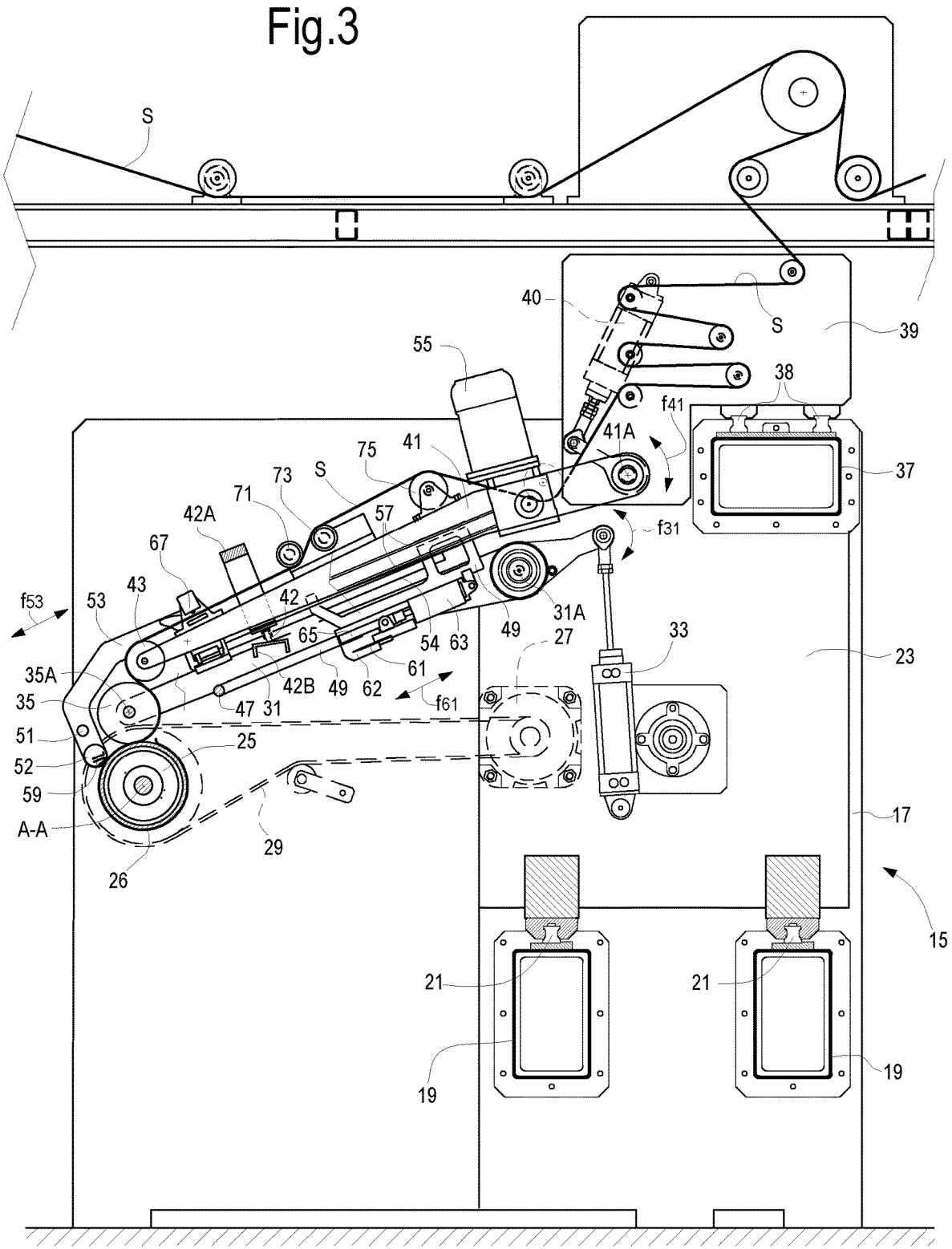
FIGS. 3 to 7 show cross-section of a winding station according to a vertical plane in different steps of the winding cycle.

In FIG. 3, a tubular winding core 26 has been mounted on the winding mandrel 25; the leading edge of a strip S of web material, generated by cutting in the previous winding cycle, has been attached to the tubular winding core. The first arm 31 and the second arm 41 have been brought to the lowest position, where the contact roller 35 rests on the tubular winding core 26, while the guide roller 43 is spaced from the contact roller 35 through the wheel 40 resting on the crossbar 40B (or through a different adequate spacing system). The strip S of web material is guided around the guide roller 43, the contact roller 35 and the tubular winding core 26, onto which the free leading edge of the strip S has been anchored in a suitable known manner.

In this step, the slide 53 is in the fully extracted position, i.e. with the guiding bars 51 and 52 supported in a cantilever fashion beyond the guide roller 35. The blade 61 is in a retracted position, advantageously protected inside a case 62, for instance.

Now, winding of the new log B can start through rotation of the winding mandrel 25 driving the tubular winding core 26, torsionally constrained thereto, into rotation. The rotation of the winding mandrel 25 is synchronous with a reciprocating rectilinear movement of the carriage 23 along the crossbars 19, so that the strip S is helically wound around the tubular winding core 26, the axial length whereof is a multiple of the width of the strip S of web material.

Figure 4:
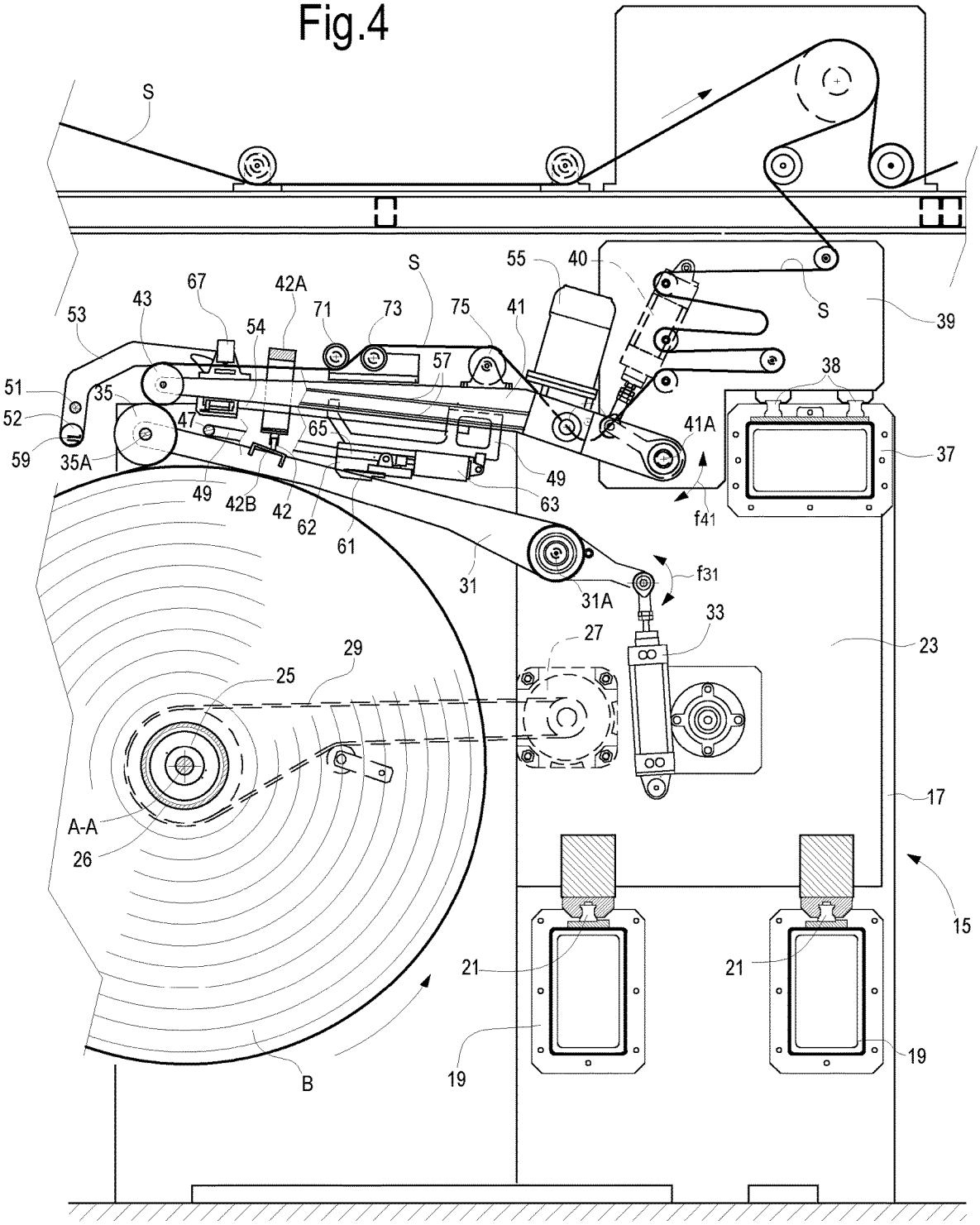

As it is clearly apparent by comparing FIGS. 3 and 4, as the diameter of the log B increases, the first arm 31 and the second arm 41 pivot upwards around respective rotation axes. In some embodiments, the actuators 33 and 40 may be off and the upward rotation movement of the first arm 31 and of the second arm 41 may simply result from the thrust upwards applied by the log B, the diameter whereof increases. In some embodiments, the actuators 33 and 40 have preferably the function of reducing the weight of the respective pivoting arms 31 and 41. The actuator 33 controls the pressure with which the contact roller 35 acts against the log being formed. In this step, the strip S of web material may be adequately guided by rollers 71, 73, 75 carried by the second arm 41.

In FIG. 4, the log B has achieved the required diameter and shall be removed from the winding mandrel 25 and replaced with a new tubular winding core 26 for forming the next log. To this end, the strip S of web material shall be cut. The operations for cutting the strip S are described below referring to the sequence of FIGS. 5, 6 and 7.

Figure 5:
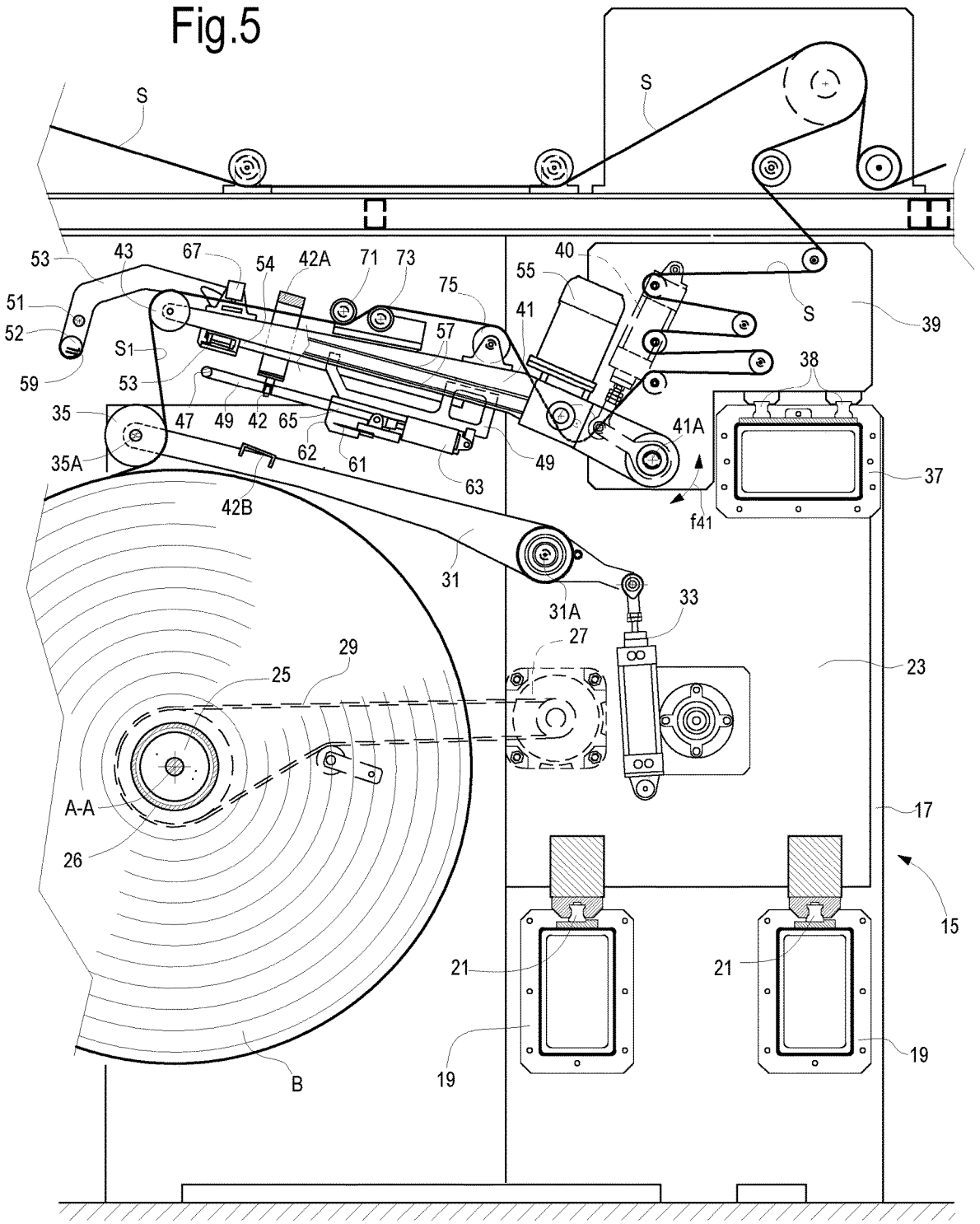

In FIG. 5, the second arm 41 has been lifted by means of the actuator 40, so as to move the guide roller 43 away from the contact roller 35. The slide 53 is still in the extracted position, with the guiding bars 51 and 52 spaced from the guide roller 43. Due to the reciprocal movement away from each other, a portion S1 of web material is formed between the guide roller 43 and the contact roller 35. The portion can be formed by feeding web material from the feed path. However, the web material portion S1 is preferably formed by unwinding the formed log B. To this end, at the end of winding the brake 67 is actuated. The electric motor 27 controlling the rotation of the winding mandrel 25 works in "torque control" mode, so that the portion S1, generated by the reciprocal movement of the contact roller 35 and of the guide roller 43 away from each other, is formed by unwinding the log B.

Figure 6:
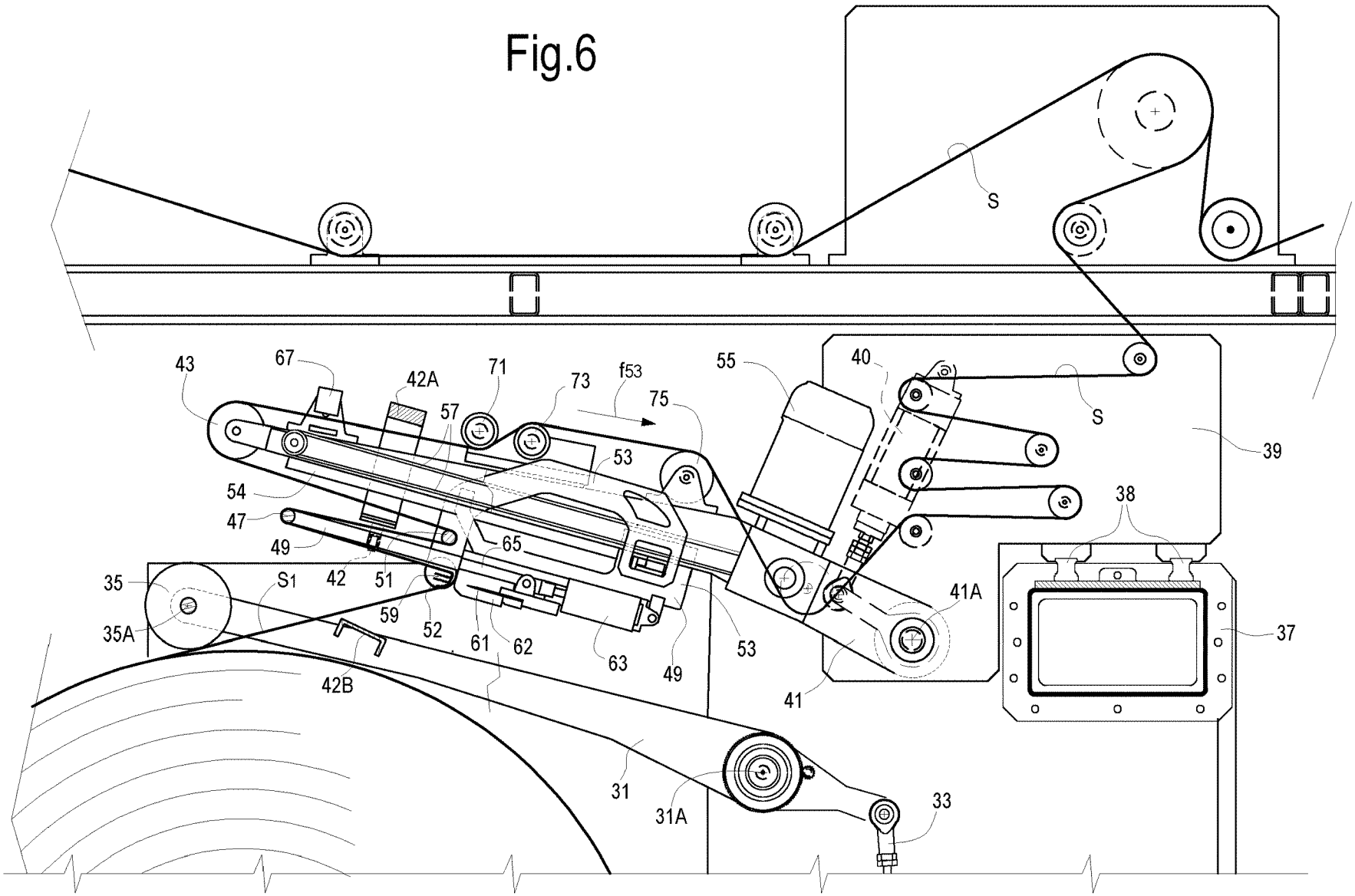

Then, the slide 53 is translated towards the rotation axis 41A of the second arm 41, up to take the position illustrated in FIG. 6. In this position, the guiding bars 51 and 52 are below the second arm 41, and are passed beyond the guiding bar 47, which is fixed with respect to the second arm 41. The reciprocal movement of the guiding bars 51, 52,47 forms two loops of web material, indicated with SA and SB. Practically, due to the movement of the guiding bars 51 and 52 with respect to the guiding bar 47, a sort of web material festoon is formed between the guide roller 43 and the contact roller 35. In this case again, the web material forming the two loops is taken from the log B. In this step, the blade 61 is still retracted in the protection case 62.

At this point, the blade 61 may be actuated by means of the actuator 63. The blade 61 thus co-acts with the anvil 59 associated with the guiding bar 52, as shown in particular in FIG. 7. The strip S of web material is thus cut, forming a tail edge LF that remains on the formed log B, and a leading edge LT that remains constrained to the second arm 41. The cut is done in correspondence of the guiding bar 52, i.e. downstream of the stock formed by the loops SA and SB. The festoon is sufficiently long to allow easily winding of a first loop around the new tubular winding core 26 when the subsequent winding cycle starts.

To facilitate cutting, the blade 59 may be flanked by two pressers, one on each side of the blade 59, elastically pressing against the edges of the anvil to hold the strip S at the sides of the blade 59. Again in order to facilitate cutting, the strip S of web material can be tensioned, once the brake 67 has been actuated, by acting on the winding mandrel 25.

Figure 7:
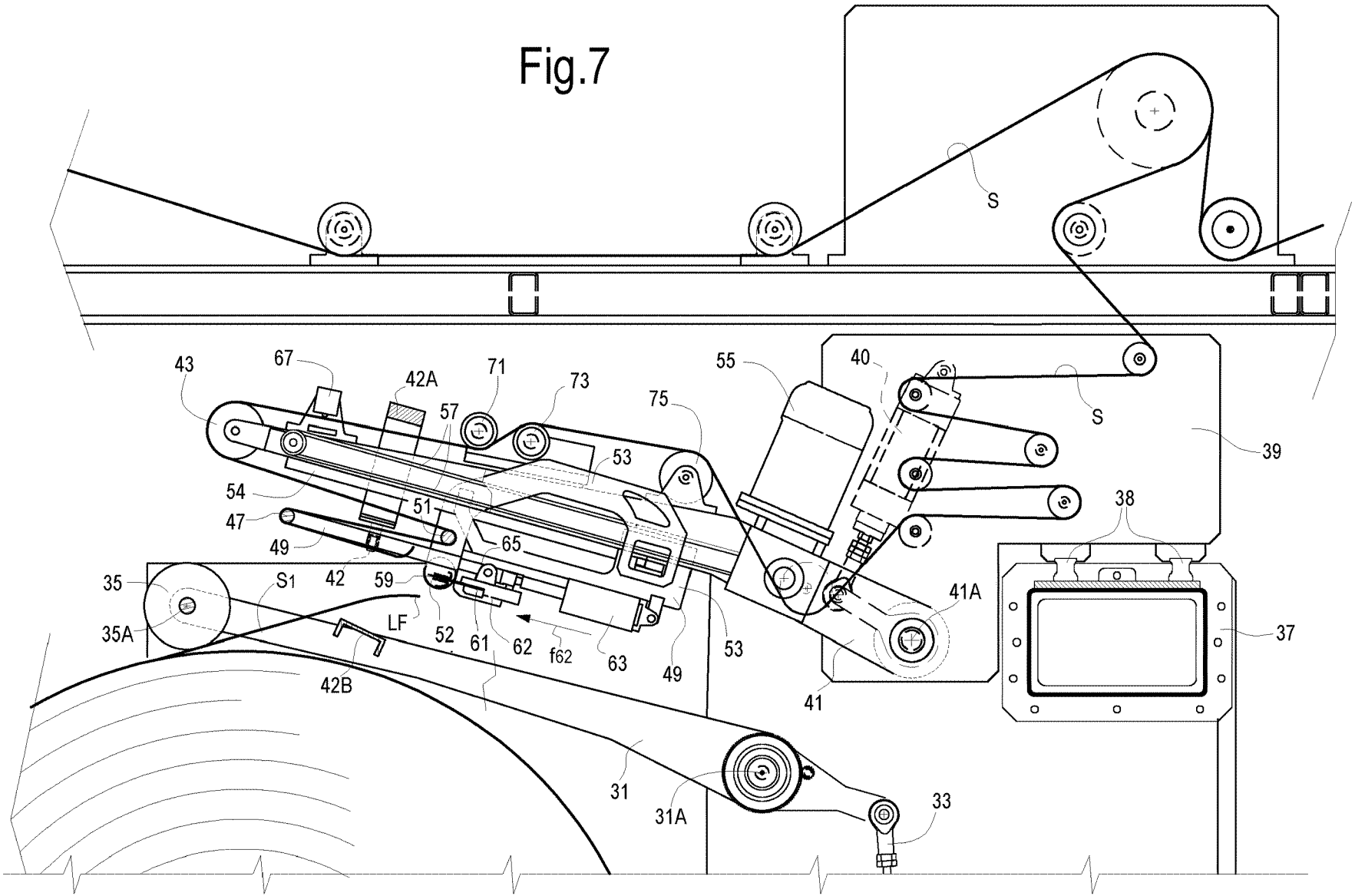

The first arm 31 may be lifted from the position of FIG. 7 by means of the actuator 33 in order to free the log B, which can be thus removed from the winding mandrel 25 allowing the insertion of a new tubular winding core 26.

When the new tubular winding core 26 has been inserted on the winding mandrel 25, the slide 53 may be brought again to the extracted position and the two arms 31, 41 may be lowered again to the position of FIG. 3. The portion of strip S of web material formed by the loops SA, SB and forming the festoon remains available for the operator, who winds it around a new tubular winding core 26 forming a first turn and attaching, in this way, the strip S to the tubular winding core 36 without the need for glue or gluing members. The length of the portion of strip S is preferably such as to allow the strip S to form a complete turn around the tubular winding core 26 and to allow the free edge of the strip S to pass beyond the contact point between the tubular winding core 26 and the contact roller 35. This allows anchoring the strip S and prevents it from being accidentally removed when the winding of the new log B starts.

The invention claimed is:

1. A machine for forming logs of web material, the machine comprising:

an unwinding section for unwinding parent reels of web material; and at least one winding station comprising:

a winding device comprising a winding mandrel;

guide members for guiding a strip of the web material, the guide members being configured to form at least a loop of the web material between a guide roller and a log arranged on the winding device; and a cutting device for transversally cutting the strip of the web material in an intermediate position between the log and the guide roller to generate a tail edge, remaining on the log being formed, and a leading edge, remaining fastened to the guide roller, wherein the winding mandrel is further provided with reciprocating translation motion in a direction parallel to a rotation axis thereof, in order to helically wind the strip of the web material around the winding mandrel.

2. The machine according to claim 1, wherein the guide members comprise a plurality of guiding elements substantially parallel to one another and movable with respect to one another, in order to form a plurality of loops of the web material.

3. The machine according to claim 1, wherein a contact roller is associated with the winding mandrel, the contact roller being configured to be pressed against an outer surface of the log during winding thereof on the winding mandrel.

4. The machine according to claim 3, wherein the contact roller and the guide roller have approximately parallel axes.

5. The machine of claim 4, wherein the guide roller and the contact roller are arranged such that the strip of the web material is guided around the guide roller and around the contact roller during winding of the log.

6. The machine according to claim 3, wherein the guide members are arranged to form said at least one loop of the web material between the guide roller and the contact roller.

7. The machine according to claim 3, wherein the contact roller is supported by a first movable arm to move the contact roller towards and away from the rotation axis of the winding mandrel.

8. The machine according to claim 7, wherein the first movable arm is mounted on a carriage carrying the winding mandrel and movable transversally with a reciprocating motion in a direction parallel to the rotation axis of the winding mandrel.

9. The machine according to claim 8, wherein the first movable arm is supported pivotally around an axis parallel to the winding mandrel.

10. The machine according to claim 1, wherein the guide roller is supported by a second movable arm so as to move the guide roller towards and away from a winding axis of the log.

11. The machine according to claim 10, wherein the second movable arm is pivotally supported around an axis parallel to the winding mandrel.

12. The machine according to claim 10, wherein at least one guiding bar is mounted on the second movable arm, the at least one guiding bar being movable with respect to the guide roller, the at least one guiding bar and the guide roller being arranged to form a loop of the web material.

13. The machine according to claim 10, wherein a first guiding bar and a pair of further guiding bars are mounted on the second movable arm, the further guiding bars being movable with respect to the first guiding bar.

14. The machine according to claim 13, wherein the first guiding bar is substantially stationary with respect to the second movable arm and to the guide roller.

15. The machine according to claim 13, wherein the pair of further guiding bars is mounted on a slide movable along the second movable arm to move towards and away from the first guiding bar.

16. The machine according to claim 15, wherein the cutting device is carried by the second movable arm, the cutting device comprising a blade co-acting with an anvil carried by the slide.

17. The machine according to claim 10, wherein the cutting device is carried by the second movable arm.

18. The machine according to claim 10, wherein a brake is provided in the winding station to block the strip of the web material after cutting, the brake being carried by the second movable arm.

19. The machine according to claim 10, wherein a brake is arranged along a feeding path of the strip of the web material, upstream of the cutting device with respect to a feeding direction of the strip of the web material, the brake being mounted on the second movable arm.

20. The machine according to claim 1, wherein a brake is provided in the at least one winding station to block the strip of the web material after cutting.

21. The machine according to claim 20, wherein the brake is arranged along a feeding path of the strip of the web material, upstream of the cutting device with respect to a feeding direction of the strip of the web material.

22. The machine according to claim 20, wherein the brake is arranged upstream of the guide roller with respect to a feeding direction of the strip of the web material.

23. The machine according to claim 1, further comprising:

a cutting station arranged downstream of the unwinding section and the cutting station comprising a cutting means to subdivide the web material, coming from the unwinding section, into strips; and a plurality of winding stations, arranged in sequence, downstream of the cutting station, each of the plurality of winding stations receiving a respective strip of the web material.

24. A method for winding a strip of web material on a log being formed and rotating around a rotation axis, with a machine according to claim 1, the method comprising the steps of:

helically winding a length of the strip of web material on a first log being formed in a winding station;

forming at least one loop of the web material between the guide roller and a formed log at an end of winding of the first log, and severing the strip of web material by a cutting device, forming a tail edge of the first log and a leading edge of a second log, leaving a portion of strip downstream of the guide roller;

removing the first log from the winding station;

inserting a new tubular winding core into the winding station;

applying the leading edge to the new tubular winding core by winding the portion of strip downstream of the guide roller around the new tubular winding core; and starting winding a new log around the new tubular winding core.

* * * * *